US008403290B2

(12) United States Patent
Delbridge et al.

(10) Patent No.: US 8,403,290 B2
(45) Date of Patent: Mar. 26, 2013

(54) WIPER SEAL ASSEMBLY

(75) Inventors: Scott Delbridge, Edmonton (CA); Dean Foote, Edmonton (CA)

(73) Assignee: Alberta Petroleum Industries Ltd., Edmonton, Alberta (CA)

( * ) Notice: Subject to any disclaimer, the term of this patent is extended or adjusted under 35 U.S.C. 154(b) by 826 days.

(21) Appl. No.: 12/135,803

(22) Filed: Jun. 9, 2008
(Under 37 CFR 1.47)

(65) Prior Publication Data

US 2009/0302243 A1 Dec. 10, 2009

(51) Int. Cl.
*E21B 33/06* (2006.01)

(52) U.S. Cl. ..... 251/1.1; 277/324; 166/85.4

(58) Field of Classification Search ..... 251/1.1–1.3; 277/322–344, 373; 166/85.4
See application file for complete search history.

(56) References Cited

U.S. PATENT DOCUMENTS

| | | | | | |
|---|---|---|---|---|---|
| 1,709,949 | A | * | 4/1929 | Rasmussen et al. | 166/86.2 |
| 2,609,836 | A | * | 9/1952 | Knox | 277/327 |
| 3,621,912 | A | * | 11/1971 | Wooddy et al. | 166/340 |
| 3,667,721 | A | * | 6/1972 | Vujasinovic | 251/1.1 |
| 4,093,239 | A | * | 6/1978 | Sugahara | 277/514 |
| 4,098,341 | A | * | 7/1978 | Lewis | 166/387 |
| 4,283,039 | A | * | 8/1981 | Schaeper et al. | 251/1.2 |
| 4,460,149 | A | * | 7/1984 | Schaeper et al. | 277/327 |
| 4,460,151 | A | * | 7/1984 | Williams et al. | 251/1.2 |
| 4,602,794 | A | * | 7/1986 | Schaeper et al. | 277/327 |
| 4,719,971 | A | * | 1/1988 | Owens | 166/191 |
| 4,834,139 | A | * | 5/1989 | Fitzgibbons | 137/614.04 |
| 4,858,882 | A | * | 8/1989 | Beard et al. | 251/1.2 |
| 6,244,336 | B1 | * | 6/2001 | Kachich | 166/55 |
| 7,055,390 | B2 | * | 6/2006 | Foote et al. | 73/700 |
| 7,210,533 | B2 | * | 5/2007 | Starr et al. | 166/376 |
| 7,247,071 | B2 | * | 7/2007 | Fujisawa et al. | 445/22 |
| 7,487,837 | B2 | * | 2/2009 | Bailey et al. | 166/345 |
| 7,669,609 | B2 | * | 3/2010 | Hansen et al. | 137/269 |
| 2004/0104540 | A1 | * | 6/2004 | Foote et al. | 277/637 |
| 2004/0188949 | A1 | * | 9/2004 | Foote et al. | 277/549 |
| 2009/0194947 | A1 | * | 8/2009 | Templeton et al. | 277/335 |

FOREIGN PATENT DOCUMENTS

| | | | |
|---|---|---|---|
| CA | 2409316 | * | 4/2004 |
| CA | 2410218 | * | 4/2004 |
| CA | 2413112 | * | 5/2004 |
| CA | 2506828 | * | 10/2006 |

OTHER PUBLICATIONS

Parker Seals—Parker Hannifin Corporation, "Parker Rod Wiper/Scrapers" Brochure; revised Jul. 1989 (pp. 1-20).*

* cited by examiner

*Primary Examiner* — John N Fristoe, Jr.
*Assistant Examiner* — Jessica Cahill
(74) *Attorney, Agent, or Firm* — Millen, White. Zelano & Branigan, P.C.

(57) ABSTRACT

A hydraulically-operated annular blowout preventer, for controlling a wellbore and comprising a wiper seal assembly, is described. The wiper seal assembly comprises a discrete wiper seal, for preventing debris and/or contaminants from the wellbore from entering the hydraulic fluid chamber of the blowout preventer, a discrete pressure seal, positioned below and abutting the wiper seal in the same seal groove, for isolating the hydraulic chamber, and a retainer member for preventing both radial and axial movement of the wiper seal.

1 Claim, 3 Drawing Sheets

WIPER SEAL ASSEMBLY

FIELD OF THE INVENTION

The present invention relates to a blowout preventer having modified annular seal assemblies at the piston interface.

BACKGROUND OF THE INVENTION

Annular or spherical blowout preventers (BOPs) are large, hydraulically operated valves used in the oil and gas industry to control a wellbore at the ground level. Annular BOPs primarily function to seal or close the wellbore, when actuated, to thereby prevent a blowout.

Structurally, annular BOPS comprise a body formed by mating upper and lower housings that enclose a deformable, resilient packing element for sealing its central bore which connects with the wellbore. The body further encloses a hydraulically operated piston, which actuates the opening and closing of the resilient packing element.

Contamination of the BOP hydraulic fluid system, by fluid and/or debris from the wellbore, needs to be prevented in order for the BOP to function properly. Various types of pressure seals are used to provide a physical separation between the fluids in the hydraulic fluid chamber of the BOP and its central bore. The prior art pressure seals conventionally used in this service, however, have not satisfactorily withstood the damage and degradation that occurs over time as a result of exposure to contaminants in the wellbore fluid. In addition, such common pressure seals are of a size and shape that they can roll or twist in use, thereby releasing their sealed engagement and allowing leakage of fluid. Accordingly, frequent inspection, repair and replacement of the common pressure seals is required in order to prevent the leakage of wellbore fluid into the hydraulic fluid system of the BOP.

One attempt to solve this problem has been to utilize what is known as a single, dual-functioning wiper seal, which serves to provide:

a) a pressure seal for preventing leakage of fluid from the wellbore into the hydraulic fluid system of the BOP, and b) a wiper seal for preventing dirt and debris from the fluid in the wellbore from entering the hydraulic fluid system.

Dual-functioning seals, however, are not effective pressure seals and are still prone to degradation over time. Frequent repair and/or replacement of dual-functioning wiper seals continues to pose a problem for BOP manufacturers and operators in the oil and gas industry.

There is therefore a need for modified annular seal assembly that is designed to effectively seal the interface between the hydraulic fluid system of a BOP and the fluid within the wellbore, while at the same time resisting damage cause by wellbore fluid contaminants.

SUMMARY OF THE INVENTION

A hydraulically-operated annular blowout preventer, for controlling a wellbore, comprising modified annular seal assemblies at the piston interface, is described. The blowout preventer comprises:

- a U-shaped annular lower housing, having upstanding, spaced apart, inner and outer walls;
- the housing defines a central bore for connecting with the wellbore;
- a vertically movable piston; and
- an adapter ring connected to the outer wall and extending toward the inner wall of the lower housing;

wherein the housing and the adapter ring form an annular hydraulic fluid chamber. The upper end of the inner wall and the adapter ring are spaced apart such as to define an annular gap. The lower end of the piston is positioned within the chamber and its upper end extends upwardly through the gap, thereby providing a physical separation between the hydraulic fluid chamber and the wellbore.

The inner wall of the housing and the adapter ring each form an annular peripheral groove at the gap and each groove is associated with:

- a discrete wiper seal, for preventing fluid and contained debris and/or contaminants originating from the wellbore from entering the hydraulic fluid chamber,
- a discrete pressure seal, positioned below and abutting the wiper seal, the pressure seal being upwardly oriented for containing pressurized wellbore fluid and isolating the hydraulic chamber at the gap, and
- a retainer member for preventing both radial and axial movement of the wiper seal.

Various advantages and features of the present invention will become readily understood from the following detailed description taken in connection with the appended claims and the attached drawings, but omitting the main packing.

DESCRIPTION OF THE PREFERRED EMBODIMENT

Figure 1:
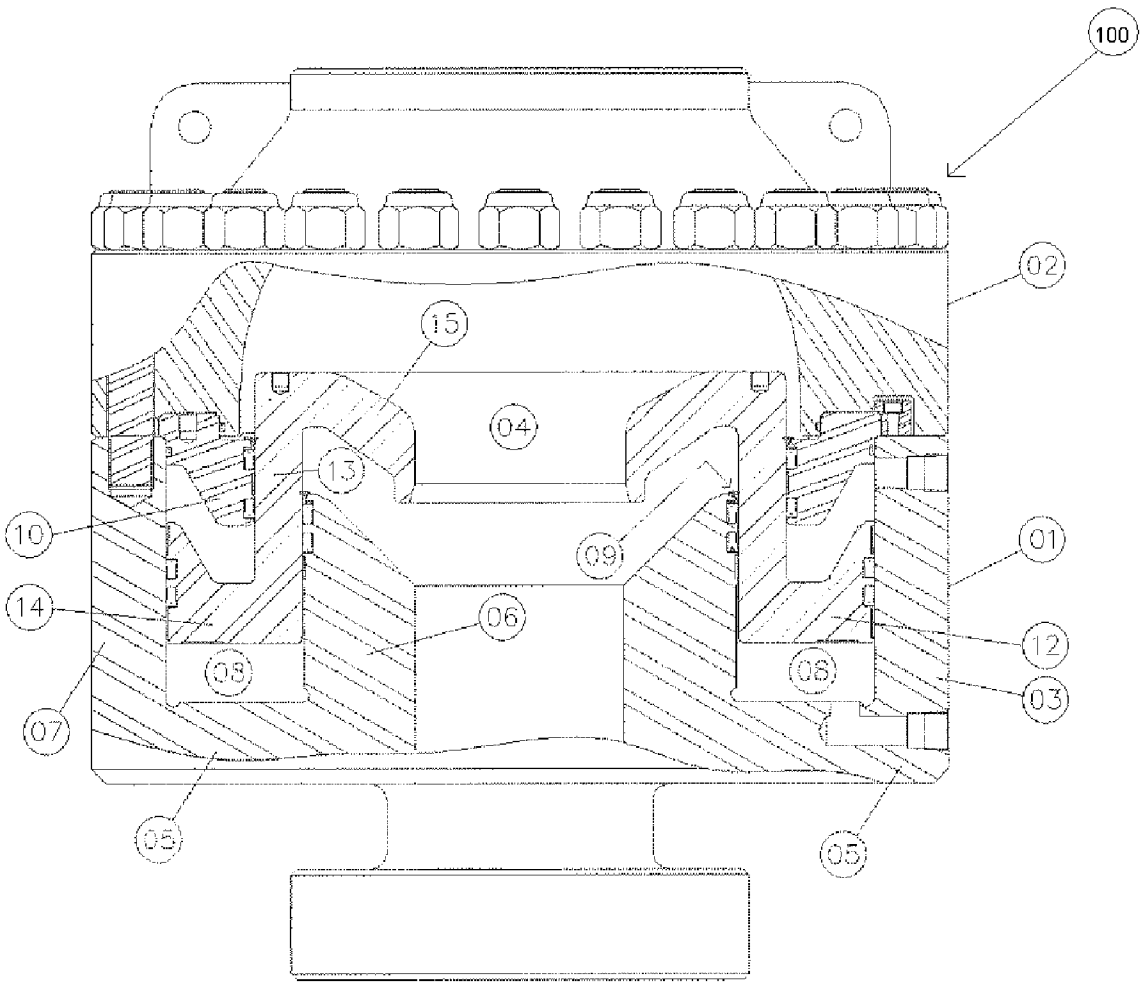
FIG. 1 is a cross sectional view of an annular blowout preventer showing two piston seal assemblies as defined herein.

A piston seal assembly will now be described with reference to FIGS. 1 to 3.

By way of background, a hydraulically operated blowout preventer (BOP), generally identified by 100, comprises a body 1, having an upper housing 2 and a lower housing 3 with a bore 4 extending therethrough. The bore 4 is an extension of, and communicates with, the wellbore of the well (not shown).

The lower housing 3 is annular and U-shaped, having a base wall 5 and inner and outer, radially spaced apart, upwardly projecting walls 6, 7. The walls 5, 6 and 7 cooperate to form an annular hydraulic fluid chamber 8. The inner wall 6 defines a section of the bore 4, which forms part of the wellbore.

An adapter ring 10 is connected with the upper end of the outer wall 7 and projects inwardly to partly close the upper end of the hydraulic fluid chamber 8. The upper end of the inner wall 6 and the adapter ring 10 define an annular gap 9 between them.

An annular piston 12 is slidably received by the chamber 8. The annular piston 12 comprises a vertically extending wall 13, an outwardly projecting lip 14 at the lower end of the piston wall 13 and an inwardly projecting lip 15 at the upper end of the wall 13. The outwardly projecting lip 14 is slidably positioned within the chamber 8, the vertically wall 13 extends through the gap 9, and the inwardly projecting lip 15 corresponds with the bore 4.

The vertical wall 13 of the piston 12 forms a first sealable interface 17 with the inner wall 6 of the lower housing 3, and a second sealable interface 19 with the adapter ring 10. First and second interfaces 17,19 seal the annular gap 9 and serve to isolate the fluid in the hydraulic fluid chamber 8 from the fluid and/or contaminants in the bore 4.

Figure 2:
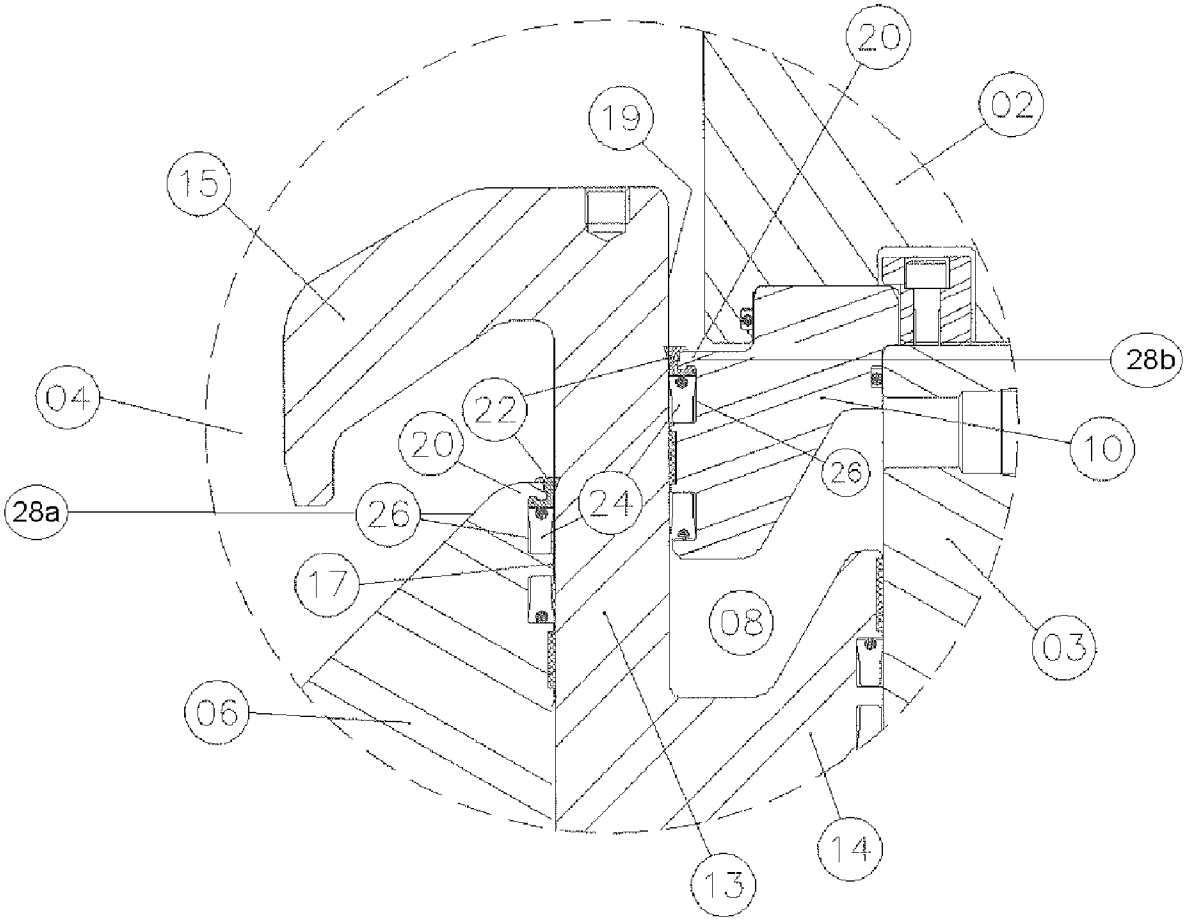
FIG. 2 is an amplified view of the piston seal assemblies as shown in FIG. 1.

Having regard to FIG. 2, a piston seal assembly, generally referred to as 20, is provided at each of the first and second interfaces 17, 19. The piston seal assembly 20 comprises a discrete wiper seal 22 and a discrete pressure seal 24 positioned within an annular peripheral groove 26 and below the wiper seal 22, so that the wiper seal 22 shields and protects the pressure seal 24 from damage and degradation due to contaminants in the bore 4.

The wiper seal 22 may be extruded nitrile rubber having a durometer hardness of at least 70 (Shore A scale). In one preferred embodiment, the durometer hardness or the wiper seal 22 is between 85-95 Shore A. In a more preferred embodiment, the durometer hardness of the wiper seal is about 95 Shore A.

The pressure seal 24 of the assembly provides a seal, upwardly oriented to prevent fluid and/or smaller contaminants that were not retained by the wiper seal 22 from leaking into the hydraulic fluid chamber 8. The pressure seal 24 may comprise a Polypak™ seal (Parker Seals, Utah, U.S.A.). In one embodiment, the pressure seal 24 may be a rectangular Polypak™ seal (Parker Seals, Utah, U.S.A.) thereby reducing the rolling or twisting of the seal within the groove 26.

Each piston seal assembly 20 further comprises a retainer member 28 *a, b*, which is specifically configured to retain the wiper seal 22 and contain the pressure seal 24 in place in the groove 26. The retainer member 28 forms the upper end of the groove 26. At the first interface 17, the first retainer member 28 *a* is formed by a lateral flange 30, that is integral to and projects outwardly from the inner wall 6, toward the inner surface of the piston's 12 vertical wall 13. At the second interface 19, a second retainer member 28 *b* is formed by a lateral flange 30 is integral to and projects inwardly from the adapter ring 10 toward the outer surface of the piston's 12 vertical wall 13.

Figure 3:
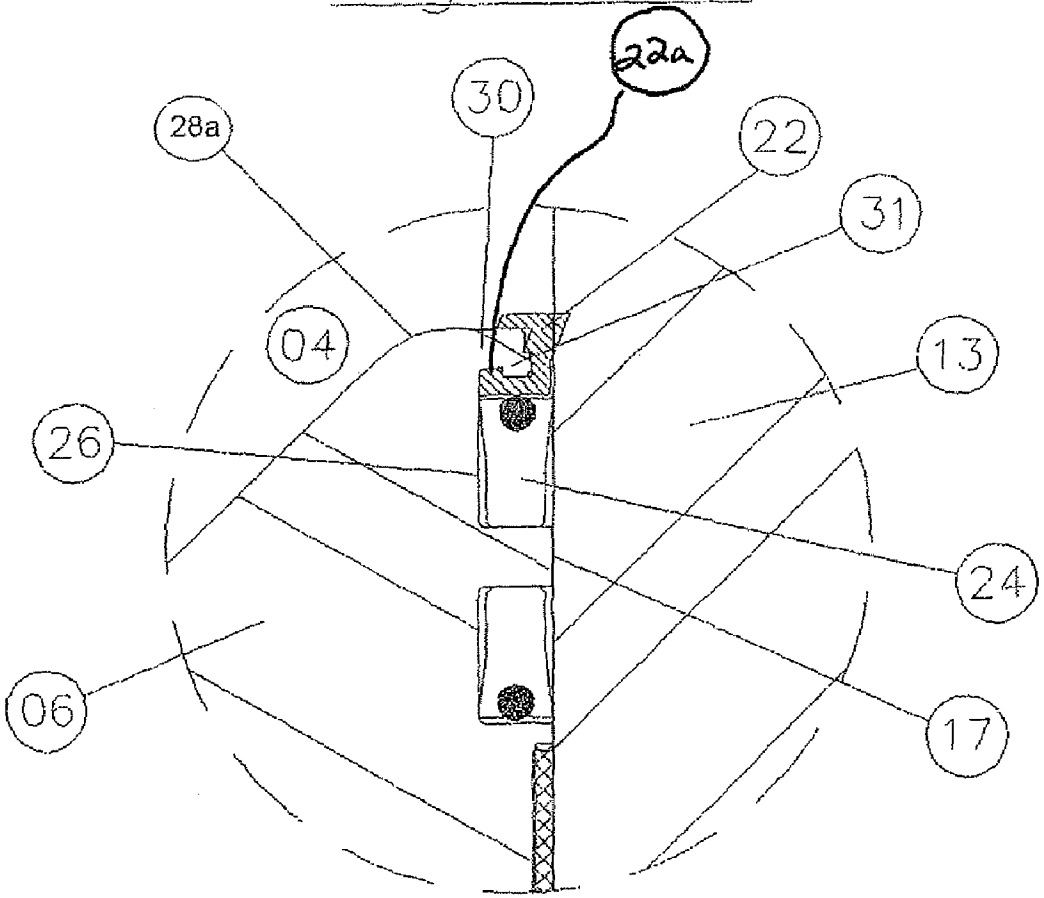
FIG. 3 is a further amplified view of one piston seal assembly as shown in FIG. 2.

In one embodiment, each retainer member 28 *a, b* further comprises a downwardly depending lug 31 which projects from the lateral flange 30, thereby forming a "hook-shaped" configuration (see FIG. 3). Each retainer member 28 *a, b* thus releasably receives or is embedded in the wiper seal 22 associated therewith in a "snap-fit" engagement and reduces both axial and radial movement of the wiper seal 22. The retainer member 28 *a, b* further retains the pressure seal 24 within the annular peripheral groove 26 by providing the lug 31, which extends downwardly into the peripheral groove 26 such that the pressure seal 24 within the groove 26 is abutted by the wiper seal 22. The wiper seal 22 has an upwardly projecting lip 22 *a* which interlocks with the lug 31, as illustrated in FIG. 3.

In use then, the wiper seal 22 is retained in a "shielding" position at the first interface 17, by interference fit, between the retainer member 28 *a* of the inner wall 6, the inner surface of the piston's 12 vertical wall 13 and the pressure seal 24. At the second interface 19, the wiper seal 22 is retained in position, by interference fit, between the retainer member 28 *b* of the adapter ring 10, the outer surface of the piston's 12 vertical wall 13 and the pressure seal 24.

In conclusions, the interlocking of the wiper seal 22 and retainer member 28 *a, b* configuration is used to effectively reduce both the axial and radial movement of the wiper seal 22 and to anchor the wiper seal 22 in a shielding relation to the pressure seal 24 within an annular BOP.

Although preferred embodiments have been shown and described, it will be appreciated by those skilled in the art that various changes and modifications to the wiper seal assembly defined herein might be made without departing from the scope of the invention. The terms and expressions used in the preceding specification have been used herein as terms of description and not of limitation, and there is no intention in the use of such terms and expressions of excluding equivalents of features shown and described or portions thereof, it being recognized that the scope of the invention is defined and limited only by the claims that follow.

Without further elaboration, it is believed that one skilled in the art can, using the preceding description, utilize the present invention to its fullest extent. The preceding preferred specific embodiments are, therefore, to be construed as merely illustrative, and not limitative of the remainder of the disclosure in any way whatsoever.

In the foregoing and in the examples, all temperatures are set forth uncorrected in degrees Celsius and, all parts and percentages are by weight, unless otherwise indicated.

The preceding examples can be repeated with similar success by substituting the generically or specifically described reactants and/or operating conditions of this invention for those used in the preceding examples.

From the foregoing description, one skilled in the art can easily ascertain the essential characteristics of this invention and, without departing from the spirit and scope thereof, can make various changes and modifications of the invention to adapt it to various usages and conditions.

What is claimed is:

1. In a hydraulically operated annular blowout preventer for controlling the issuance of pressurized fluid, containing debris such as solid particles, from a wellbore, comprising:

a U-shaped annular lower housing having upstanding, spaced apart inner and outer walls;

the housing forming a central bore for connection with the wellbore;

the housing containing a vertically actuated piston;

an adapter ring connected to the outer wall and extending toward the inner wall whereby the lower housing and the adapter ring form an annular hydraulic fluid chamber;

the upper end of the inner wall and the adapter ring being spaced apart to define an annular gap;

the lower end of the piston being positioned within the chamber and its upper end extending through the gap;

the inner wall and the adapter ring each forming annular peripheral grooves at the gap;

the improvement comprising a piston seal assembly associated with each groove and comprising, in combination:

a hook-shaped retainer member forming the upper end of each groove, the retainer member having a lateral flange and a lug depending downwardly from the flange;

a discrete wiper seal associated with each retainer member and extending into the upper end of the adjacent groove, the wiper seal having an inner, upwardly extending lip for interlocking with the lug and being operative to seal against the piston, the wiper seal being directly exposed to pressurized wellbore fluid when such fluid is present in the central bore, the retainer member flange and lug being embedded in the wiper seal so that the retainer member functions to secure the wiper seal against both radial and axial movement caused by movement of the piston, the wiper seal further being operative to scrape the surface of the piston as it moves past;

each wiper seal being formed of nitrile rubber having a Shore A durometer hardness of between 85 to 95; and a discrete pressure seal positioned in each groove, said pressure seal abutting the base of the adjacent wiper seal and the bottom of the groove, said pressure seal being upwardly oriented and having at least two extending legs abutting the base of the adjacent wiper seal and operative to isolate the hydraulic fluid chamber from pressurized wellbore fluid when present in the bore;

wherein the wiper seal functions to prevent debris adhering to the piston from reaching the pressure seal.

* * * * *